US009970637B2

(12) United States Patent
Verheyen

(10) Patent No.: US 9,970,637 B2
(45) Date of Patent: May 15, 2018

(54) MODULAR LED ARRAY GRID AND METHOD FOR PROVIDING SUCH MODULAR LED ARRAY GRID

(71) Applicant: PHILIPS LIGHTING HOLDING B.V., Eindhoven (NL)

(72) Inventor: Jozef Hendricus Maria Robertus Verheyen, Turnhout (BE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 25 days.

(21) Appl. No.: 14/424,048

(22) PCT Filed: Aug. 30, 2013

(86) PCT No.: PCT/IB2013/058145

§ 371 (c)(1),
(2) Date: Feb. 26, 2015

(87) PCT Pub. No.: WO2014/033671

PCT Pub. Date: Mar. 6, 2014

(65) Prior Publication Data

US 2015/0219326 A1 Aug. 6, 2015

Related U.S. Application Data

(60) Provisional application No. 61/695,631, filed on Aug. 31, 2012.

(51) Int. Cl.
*F21S 4/00* (2016.01)
*F21V 23/00* (2015.01)
(Continued)

(52) U.S. Cl.
CPC ..... *F21V 23/001* (2013.01); *F21K 9/90* (2013.01); *F21S 4/15* (2016.01); *F21V 23/003* (2013.01);
(Continued)

(58) Field of Classification Search
CPC .... F21V 23/001; F21V 23/005; F21V 23/003; F21S 4/15; F21K 9/90; H01R 4/28; F21Y 2105/10
(Continued)

(56) References Cited

U.S. PATENT DOCUMENTS

2006/0039142 A1 2/2006 Temple
2008/0009165 A1 1/2008 Tseng
(Continued)

FOREIGN PATENT DOCUMENTS

CN 2622979 Y 6/2004
EP 1990573 A1 11/2008
(Continued)

OTHER PUBLICATIONS

English translation of JP 3031093 U (Oct. 11, 2017).*

*Primary Examiner* — Anh Mai
*Assistant Examiner* — Hana Featherly

(57) ABSTRACT

The invention provides a modular LED array grid (100) comprising a plurality of LED array grid modules (50), each LED array grid module (50) comprising one or more arrays (151) of adjacent electrically conductive wires (51) with one or more LEDs (10) electrically coupled to two adjacent electrically conductive wires (51), wherein two adjacent electrically conductive wires (51) of at least one of the one or more arrays (151) have a first distance (d1) at the one or more LEDs (10), and have one or more folds (52) which provide a second distance (d2) between the two adjacent electrically conductive wires (51) which is larger than the first distance (d1), wherein two or more of said array grid modules (50) are coupled to each other with one or more coupling parts (60) between one or more folds (52) of a first
(Continued)

array (151(1)) and the conductive wire (51) of an adjacent second array (151(2)). This grid (100) may be obtainable by the method of the invention.

15 Claims, 9 Drawing Sheets

(51) Int. Cl.

| | |
|---|---|
| ***F21K 9/90*** | (2016.01) |
| ***H01R 4/28*** | (2006.01) |
| ***F21S 4/15*** | (2016.01) |
| *F21Y 105/10* | (2016.01) |
| *F21Y 115/10* | (2016.01) |

(52) U.S. Cl.
CPC ..... *F21V 23/005* (2013.01); *H01R 4/28* (2013.01); *F21Y 2105/10* (2016.08); *F21Y 2115/10* (2016.08)

(58) Field of Classification Search
USPC ..... 362/249.02
See application file for complete search history.

(56) References Cited

U.S. PATENT DOCUMENTS

2008/0316742 A1* 12/2008 Zhou ..... H05B 33/0803 362/231
2013/0270581 A1* 10/2013 Lowes ..... H01L 33/48 257/88

FOREIGN PATENT DOCUMENTS

| | | | |
|---|---|---|---|
| JP | 3031093 | U | 11/1996 |
| WO | 2007122534 | A1 | 11/2007 |
| WO | 2007122566 | A1 | 11/2007 |
| WO | 2012095610 | A1 | 7/2012 |

* cited by examiner

MODULAR LED ARRAY GRID AND METHOD FOR PROVIDING SUCH MODULAR LED ARRAY GRID

CROSS-REFERENCE TO PRIOR APPLICATIONS

This application is the U.S. National Phase application under 35 U.S.C. § 371 of International Application No. PCT/IB13/058145, filed on Aug. 30, 2013, which claims the benefit of U.S. Provisional Patent Application No. 61/695,631, filed on Aug. 31, 2012. These applications are hereby incorporated by reference herein.

FIELD OF THE INVENTION

The invention relates to a method for providing a modular LED array grid. The invention further relates to a modular LED array grid, obtainable with such method. Further, the invention relates to a lighting arrangement comprising such modular LED array grid.

BACKGROUND OF THE INVENTION

As known from the art, light emitting diodes (LEDs) have been used as backlight for displays and illumination panels for some time, where a large number of low power LEDs are arranged in an array. LEDs are well suited for this purpose for several reasons. They are, for instance, durable structures with a long lifetime, which reduces the maintenance needed. Also, they have low power consumption and are operated at lower voltages, which reduce costs of operation and risks related to high voltage applications. In relation to this they have a high light output.

SUMMARY OF THE INVENTION

Prior art techniques include the arrangement of LEDs on printed circuit boards (PCBs). This is, however an expensive solution, especially when the LEDs are on a large pitch.

Further, modular LED array grid of the prior art may be complicated to make, sometimes include processing steps that may damage wire-LED connections and may be difficult to apply and/or difficult to scale to dimensions desired by the end user.

Hence, it is an aspect of the invention to provide an alternative modular LED array grid and/or a method for providing such modular LED array grid, which preferably further at least partly obviate one or more of above-described drawbacks.

In a first aspect, the invention provides a method for providing a modular LED array grid (herein also indicated as "grid"), the method comprising:

providing a plurality of LED array grid modules (herein also indicated as "modules"), wherein each LED array grid module comprises one or more arrays of adjacent electrically conductive wires with one or more LEDs electrically coupled to two adjacent electrically conductive wires, wherein two adjacent electrically conductive wires of at least one of the one or more arrays have a first distance (d1) at the one or more LEDs, and have one or more folds which provide a second distance (d2) between the two adjacent electrically conductive wires which is larger than the first distance (d1), and providing the modular LED array grid by coupling two or more array grid modules with one or more coupling parts between one or more folds of a first array and the conductive wire of an adjacent second array.

Such method may advantageously provide in a relative easy way the modular LED array grid. The array grid modules may be coupled in a relative simple way, and thereby, the desired dimensions of the modular LED array grid can be created. This can be done at the end user but alternatively or additionally, two or more modules may be coupled to provide an intermediate grid, which may later be coupled to other modules and/or intermediate grids, or the final grid may be provided. Hence, scalability is great, without any loss of functionality. Mechanization of the process may be relative easy. In addition, as also further indicated below, the modules may optionally be cut to the desired lengths, and nevertheless be functionally coupled to each other to form the grid (which can be used for lighting).

Hence, in a further aspect, the invention also provides such modular LED array grid comprising:

a plurality of LED array grid modules, wherein each LED array grid module comprises one or more arrays of adjacent electrically conductive wires with one or more LEDs electrically coupled to two adjacent electrically conductive wires for providing electrical power to the one or more LEDs, wherein two adjacent electrically conductive wires of at least one of the one or more arrays have a first distance (d1) at the one or more LEDs, and have one or more folds which provide a second distance (d2) between the two adjacent electrically conductive wires which is larger than the first distance (d1), wherein two or more of said array grid modules are coupled to each other with one or more coupling parts between one or more folds of a first array and the conductive wire of an adjacent second array. This grid may be obtainable by the method of the invention.

The grid may comprise two or more modules, but may in general comprise at least four modules, such as 4-400 modules, like at least eight modules. The grid may span an area of for instance 2-400 $m^2$, such as 4-400 $m^2$. The modules may in principle have any length, but will in general have a length of about 0.5-10 m, such as 1-5 m. The number of LEDs per module and on a grid may vary. On a grid, the number of LEDs per $m^2$ (LED density) may for instance be in the order of 1-400, such as 4-100, though there may be grids with more or even with less LEDs. The number of LEDs on a module may for instance be in the range of 1-100. Herein, the term "LEDs" may also refer to the term "plurality of LEDs".

Note that the distribution of the LEDs over a grid may be regular, although there may also within one grid two or more subsets of modules with different numbers of LEDs on the modules, respectively, or with different LED densities. In general, the LEDs will be arranged in a regular pattern, though other patterns may not be excluded. However, in general the arrangement of the modules will be regular.

The LEDs are especially solid state LEDs, but may optionally also be organic LEDs. Also combinations of solid state and organic LEDs may be applied. The LEDs may be configured to provide one color light, such as white light, but may also be configured to provide different colors of light.

The term "LED" may also relate to a plurality of LEDs. Hence, in an embodiment, at a single LED position, a plurality of LEDs may be arranged, such as a white emitting LED package of 2 or more LEDs. The LEDs are especially designed to generate visible light.

As indicated above, each module comprises at least one array of adjacent electrically conductive wires. The term "adjacent" does not imply that the distance between those adjacent wires is constant over their length. In contrast, at some places the above and below indicated folds lead to a local larger distance (indicated as second distance) between the adjacent conductive wire (than at those positions where the LED is arranged on or between the conductive wires; the distance between the wires at locations of the LEDs are indicated as first distance). The electrically conductive wires are herein also indicated as "conductive wires" or simply "wires". In general, each array comprises two wires for applying a potential difference to the LED(s). When more than one LED is arranged to the two adjacent conductive wires, there LEDs are preferably arranged in parallel (parallel circuit). Each array may be powered by a power supply individually, but arrays may also be electrically coupled, such as via conductive connectors (see also below). A module may in an embodiment comprise a single array, but may in another embodiment comprise a plurality of arrays. In an embodiment, the plurality of arrays are arranged in series and in another embodiment, the plurality of arrays are arranged parallel.

The folds create a broadening or increase in width of the array, and thus the module. In this way, larger areas can be occupied, whereas less material may be necessary. The modules may be coupled between one or more folds on one module, and an array of another module, but folds of one module may also be coupled with folds of another module, thereby even more increasing the area covered with the grid. Hence, in a specific embodiment the method comprises coupling two or more array grid modules with one or more coupling parts between one or more folds of the first array and one or more folds of the adjacent second array. Hence, in a specific embodiment, two or more of said array grid modules are coupled to each other with one or more coupling parts between one or more folds of a first array and one or more folds of the adjacent second array. The term "fold" may optionally also refer to for instance "bend" or "wrinkle" In general, the folds are wire folds; i.e. one or more of the conductive wires comprise a wire fold.

In a specific embodiment, the adjacent electrically conductive wires and the one or more folds are configured in one plane. Optionally, or alternatively, one or more conductive wires comprise first wire elements which are configured in a single plane and second wire elements which protrude from said plane. Those protruding wire elements may for instance assist arranging the grid between two other elements, such as a support and a cover (see also below). These protruding elements may be attached to or be part of the conductive wires and/or to the folds, but are especially attached to or be part of to the folds. The coupling parts can be any type of coupling parts, but especially one or more coupling parts comprise a coupling part selected from the group consisting of a staple coupling, a solder coupling, a wire wrap coupling, and a weld coupling. An advantage of the invention may also be that the modules may be reduced in length to the length desired. In such embodiment, in the final application electrically conductive connections may be necessary to provide electrical contact. The coupling parts are especially used to functionally couple (or connect) two adjacent modules. Combinations of different types of coupling parts, or even within one coupling element different types of coupling principles, may also be applied.

Electrically conductive connections may be advantageous anyhow in order to maximize electrical connectivity and thereby reduce the chances of failure of one or more light sources. Hence, in an embodiment, one or more coupling parts are electrically conductive.

The LEDs may be arranged to the conductive wires when the folds are not yet present, and thus folds are created afterwards, but in another embodiment, first one or more of the wires are provided with folds, and then the LEDs are arranged to the wires. Hence, in an embodiment, the method comprises providing two adjacent electrically conductive wires, providing one or more of the folds in one or more of the wires, and subsequently arranging one or more LEDs to the two adjacent electrically conductive wires, to provide the array. In yet another embodiment, the method comprises providing two adjacent electrically conductive wires, arranging one or more LEDs to the two adjacent electrically conductive wires, and subsequently providing one or more of the folds in one or more of the wires, to provide the array. In an embodiment, the folds may be provided by stretching the electrically conductive wire(s).

The grid may be arranged to a ceiling or a wall, although applications on the floor may also be necessary. Optionally, the grid may be integrated in a room divider or may hang from a ceiling. Especially, the method may also include arranging the modular LED array grid between a support and a light transmissive cover. Hence, in a further aspect, the invention also provides a lighting arrangement comprising a support, a transmissive cover, and the modular LED array grid according to any one of claims 8-12, with the modular LED array grid configured between said support and said transmissive cover. The transmissive cover may be a closed transmissive cover, but may in another embodiment comprise a plurality of bars, with openings in between, or a grid, with grid (gauze) openings. Especially the latter transmissive cover can be used to limit glare, when arranged in front of the light sources. In an embodiment, the transmissive cover is a translucent cover.

The grid may be connected to a power supply. Hence, in a further aspect, the invention also provides an arrangement of the grid and a power supply. Further, the grid may be connected to a control unit. Hence, in a further aspect, the invention also provides an arrangement of the grid and a control unit, and optionally a power supply. The control unit may be configured to control one or more of the intensity of the light, the color of the light, the hue of the light, etc. Optionally, the control unit may be configured to individually control two or more subsets of LEDs. In the latter embodiment, the grid may also be used to show light patterns and/or information (including images).

The term "substantially" herein, such as in "substantially all emission" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices or apparatus herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to an apparatus or device comprising one or more of the characterizing features described in the description and/or shown in the attached drawings. The invention further pertains to a method or process comprising one or more of the characterising features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF THE EMBODIMENTS

Figure 1A:
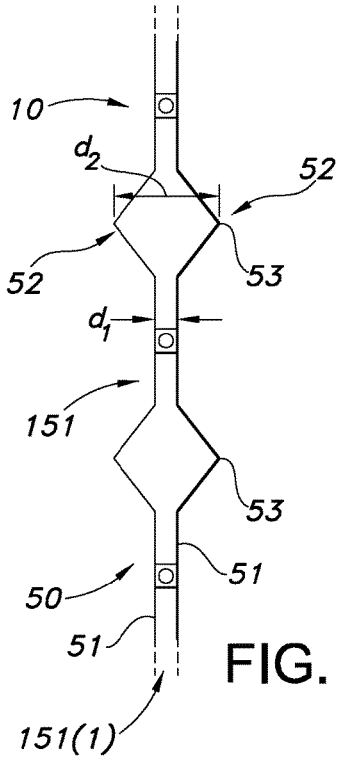
FIGS. 1*a*-1*d* schematically depicts some possible aspects of the invention.
Figure 1B:
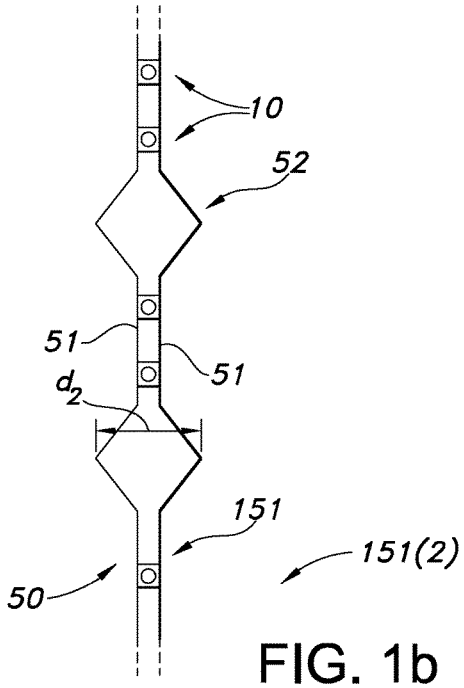

FIGS. 1*a* and 1*b* schematically depict an array 151 of adjacent electrically conductive wires 51 with one or more LEDs 10 electrically coupled to two adjacent electrically conductive wires 51. These conductive wires 51 can be used to power the one or more LEDs 10. The power source is not depicted The two adjacent electrically conductive wires 51 have a first distance d1 at the one or more LEDs 10. Further, the electrically conductive wires 51 have one or more folds 52 which provide a second distance d2 between the two adjacent electrically conductive wire 51 which is larger than the first distance d1. Especially d2/d1>1.5, such as 2-4. Here, both conductive wires have folds 52, though optionally also one may have such fold. Especially, the folds 52 are arranged symmetrical on both wires 51, by which the largest array width (here≈d2) is obtained (as in these embodiments).

In FIG. 1*a* by way of example between the folds 52 one LED 10 is placed, whereas in FIG. 1*b* two LEDs 10 are placed between the folds 52. Other arrangements are possible as well.

Two or more of said array grid modules 50 can be coupled to each other with one or more coupling parts 60 between one or more folds 52 of a first array, indicated with reference 151(1) and the conductive wire 51 of an adjacent second array, indicated with reference 151(2). This is schematically shown in FIGS. 1*c* and 1*d*. in this way, a modular LED array grid 100 comprising a plurality of LED array grid modules 50 is obtained.

Figure 1C:
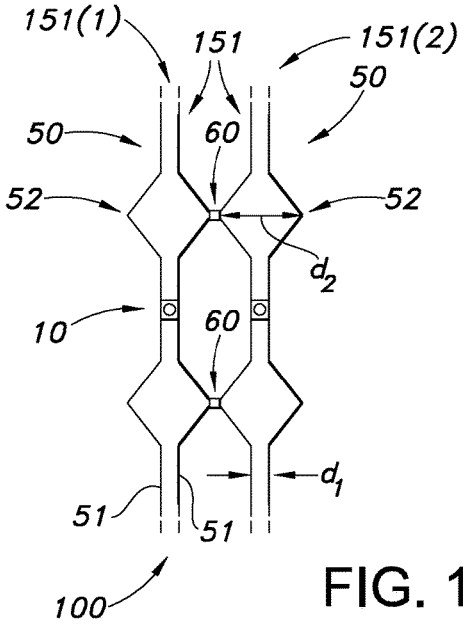
Figure 1D:
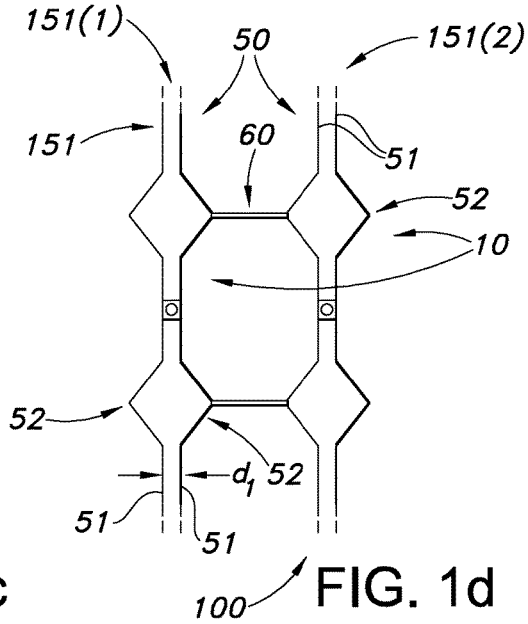

Both FIGS. 1*c* and 1*d* can show two array grid modules 50 with coupling parts 60 between folds 52 of the first array 151(1) and folds 52 of the adjacent second array 151(2). This leads to a broad module 50, which is in FIG. 1*d* even broader due to the fact that the coupling parts 60 are configured to arrange the adjacent wires of the first and second array at a distance from each other. In FIG. 1*c*, the extremities of the folds 52, indicated with references 53, may touch each other; in FIG. 1*d* these extremities are at a non-zero distance from each other.

Figure 2A:
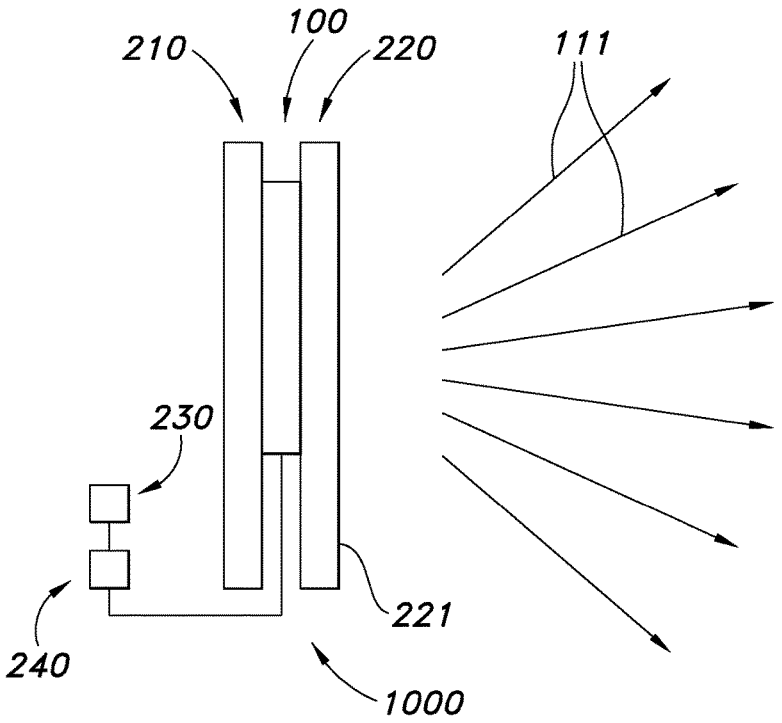
FIGS. 2*a*-2*c* schematically depicts a possible embodiment and some variants thereon.
Figure 2B:
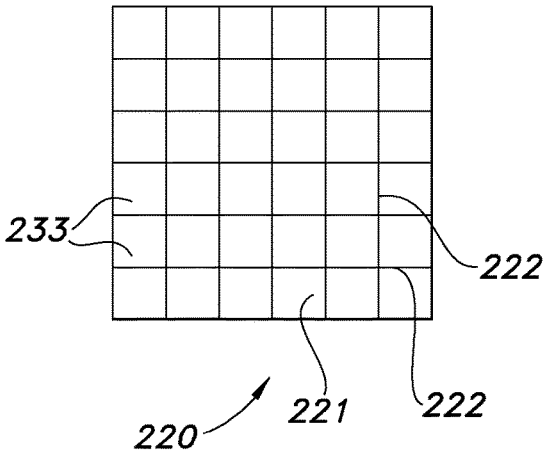
Figure 2C:
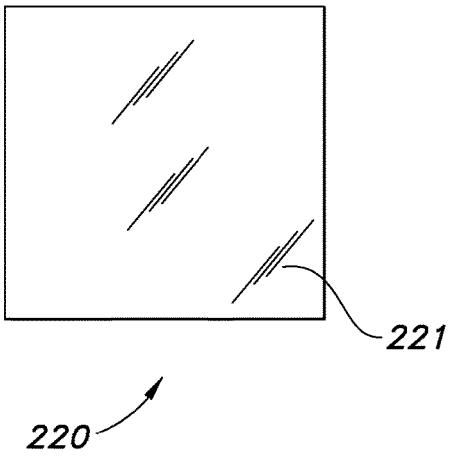

FIG. 2*a* schematically depicts a possible embodiment and some variants thereon. FIG. 2*a* schematically depicts an embodiment of an application wherein the modular LED array grid 100 is arranged between a support 210 and a light transmissive cover 220. Optionally, the light transmissive cover 220 may be absent. The light transmissive cover 220 may be an entity having physical openings 223, such as schematically depicted in the embodiment of FIG. 2*b*, or may be a closed entity, such as schematically depicted in FIG. 2*c*. In the former figure, a gauze type of light transmissive cover 220 may be applied, which may be arranged in such a way in front of the grid 100, that glare is reduced. For instance, no direct light may be perceived by an observer looking at the grid 100 (or in light transmissive cover 220) under an angle equal to or smaller than 60°, such as equal to or smaller than 45°, like at least equal to or smaller than 30° with a normal to the grid 100 (or in light transmissive cover 220). In FIG. 2*a*, the light transmissive cover 220 may comprise anti-glare bars 222. Hence, in FIG. 2*b* the top face, indicated with reference 221, may have openings (through holes), whereas in FIG. 2*c* the top face 221 may be closed. For instance, the light transmissive cover 220 may be a translucent or optionally transparent layer or plate.

FIG. 2*a* further schematically depicts a power supply 230 and optional control unit 240. The control unit 240 may be configured to control one or more of the intensity of the light, the color of the light, the hue of the light. Optionally, the control unit 240 may be configured to individually control two or more subsets of LEDs 10 (not shown in FIG. 2*a*).

FIGS. 3*a*-6*b* schematically depict a plurality and non-limiting number of possible embodiments, as well as again some variants thereon.

Figure 3A:
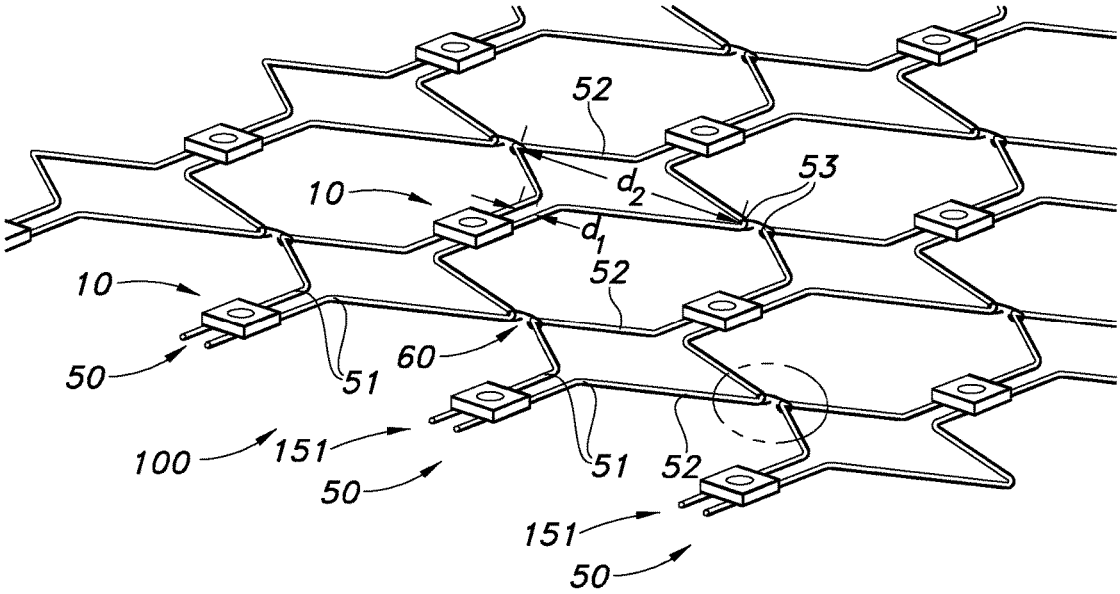
FIGS. 3*a*-3*c* schematically depicts a possible embodiment and some variants thereon.

FIG. 3*a* schematically depicts an embodiment which is substantially the same as schematically depicted in FIG. 1*c*.

Figure 3B:
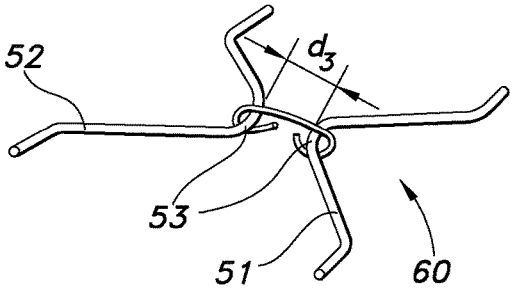
Figure 3C:
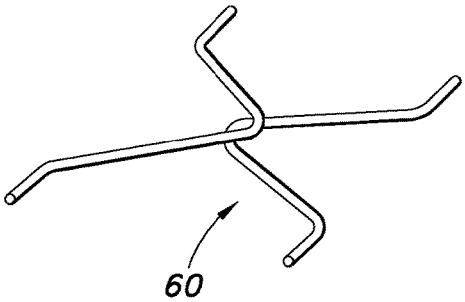

FIG. 3*b* schematically depicts an embodiment of the connection 60, which is here a staple connection. FIG. 3*c* schematically shows an embodiment of connection 60, which is here for instance a weld or solder connection. Especially, the connections are electrically conductive, such that power to the LEDs may be provided via different ways and interruption of wires is not immediately detrimental for one or more LEDs 10.

Figure 4A:
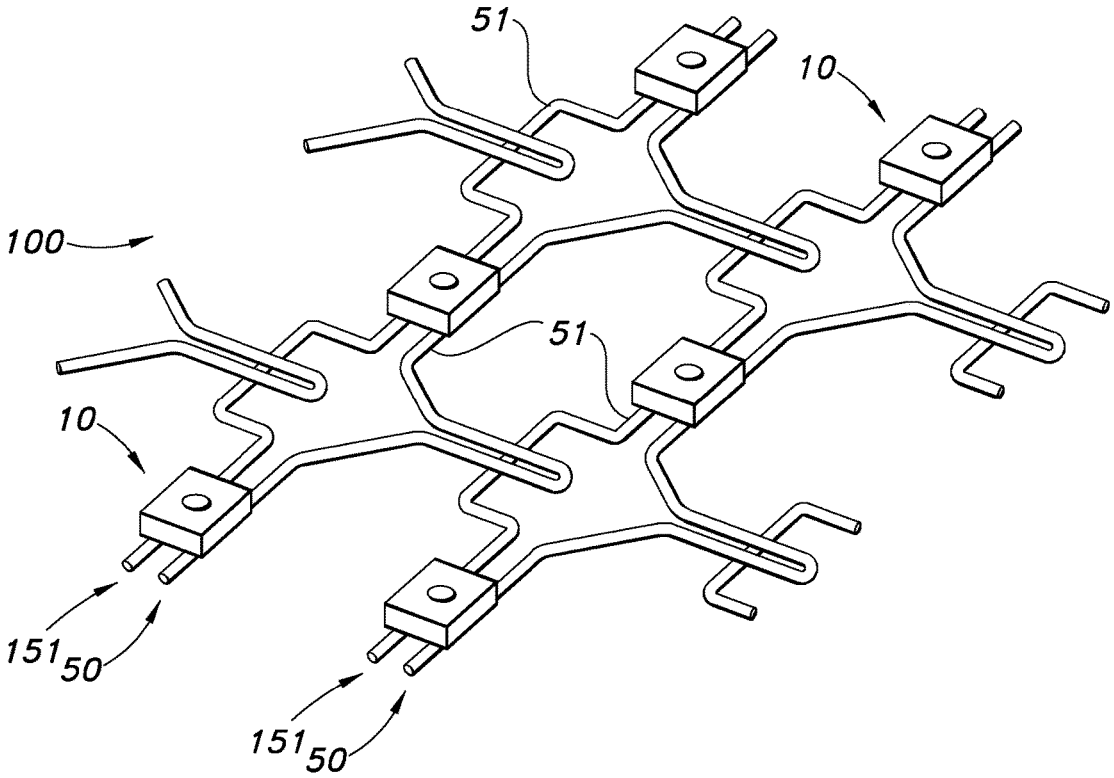
FIGS. 4*a*-4*c* schematically depicts a possible embodiment and some variants thereon.
Figure 4B:
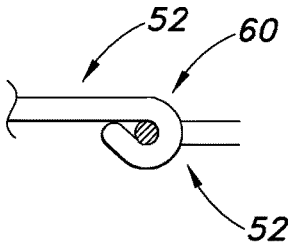
Figure 4C:
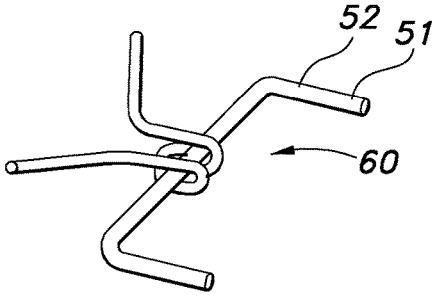

FIG. 4*a* schematically depicts an embodiment of the grid 100, wherein the folds 52 have shapes such, that the fold of a wire can be at least partly bent around a fold of an adjacent wire of another array 151. Also in this way, modules 50 can be coupled.

Figure 5A:
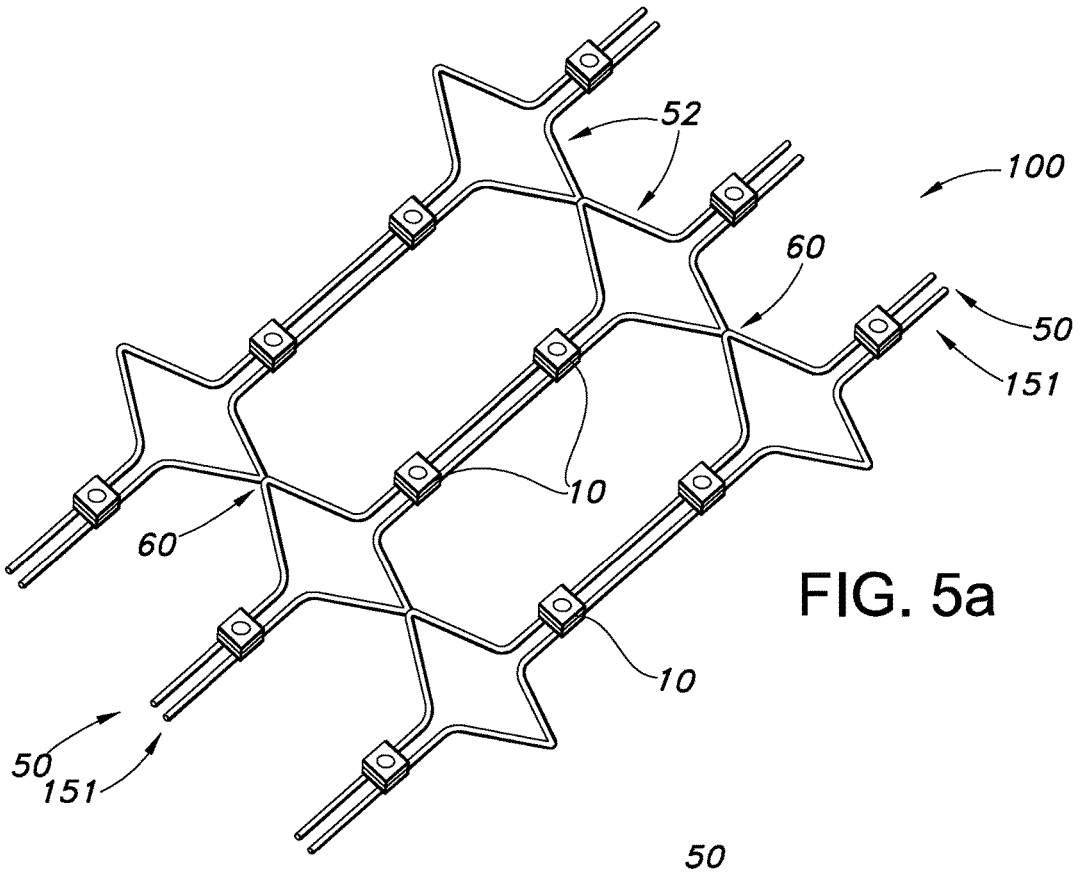
FIGS. 5*a*-5*b* schematically depicts a possible embodiment and some variants thereon.
Figure 5B:
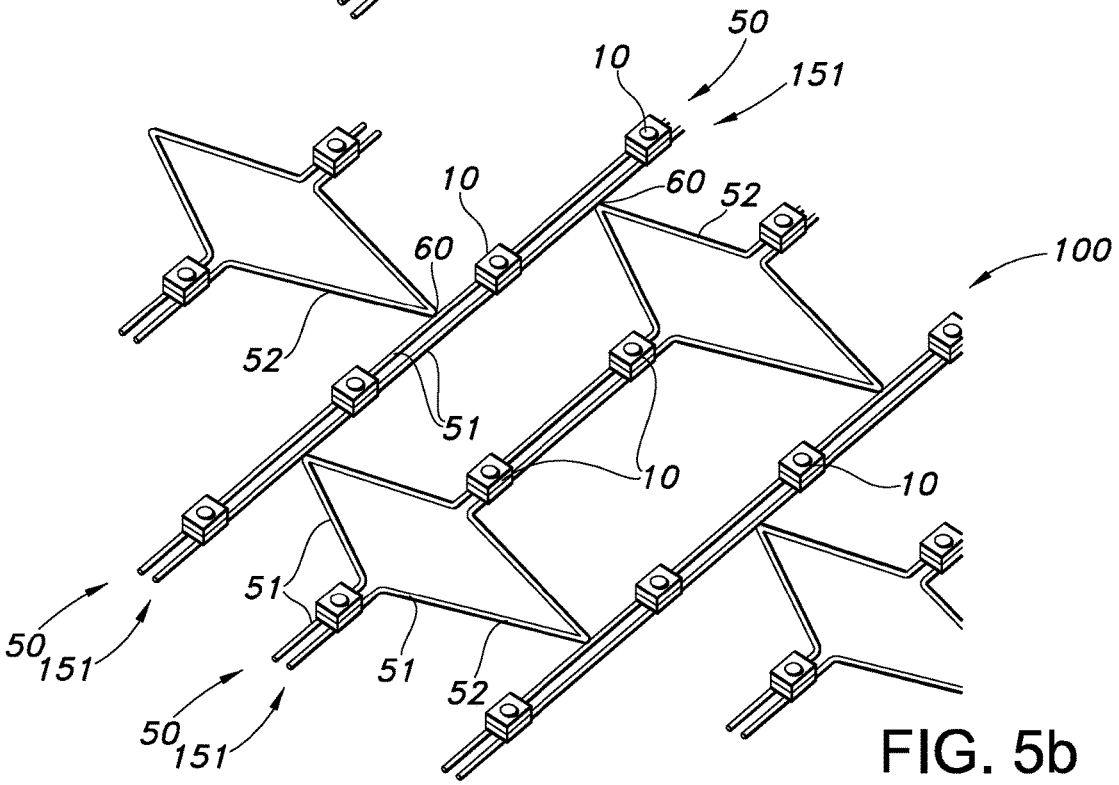

FIGS. 5*a* and 5*b* show different arrangements of the modules 50, wherein in FIG. 5*a* folds 52 of adjacent modules 50 are connected, wherein in FIG. 5*b* modules are applied with a subset of modules 50 without folds 52 and a subset of modules 50 with folds. These may for instance, as here schematically depicted, be arranged alternatingly. Also in this way, one may couple two or more array grid modules 50 with one or more coupling parts 60 between one or more folds 52 of a first array 151(1) and the conductive wire 51 of an adjacent second array 151(2).

Figure 6A:
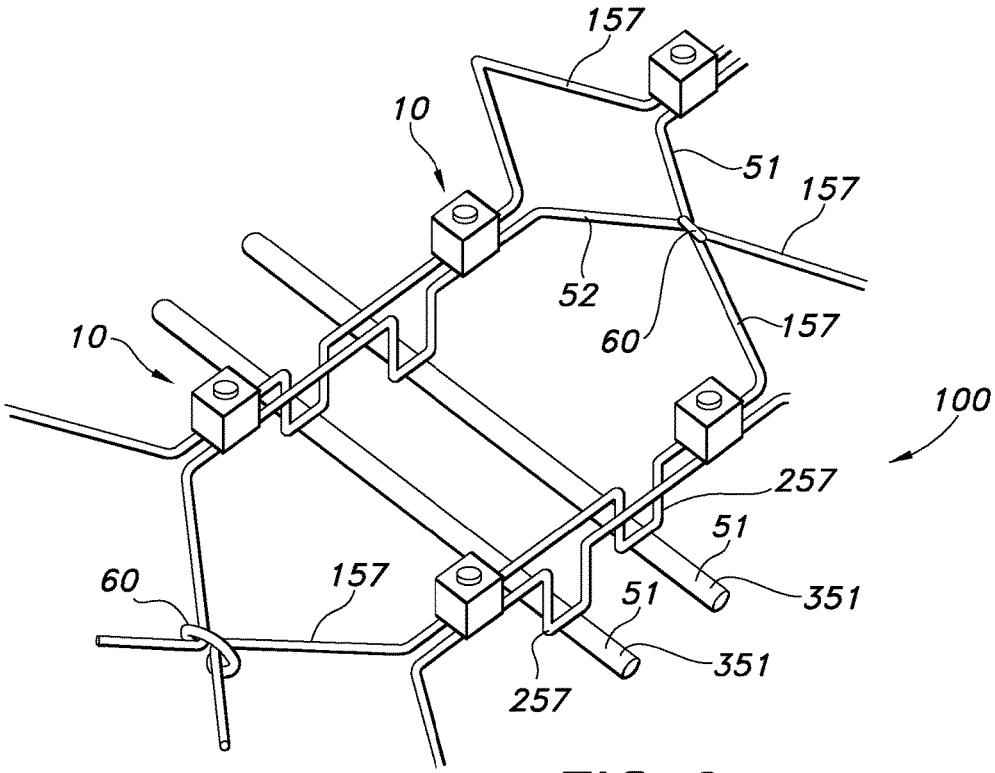
FIGS. 6*a*-6*b* schematically depicts a possible embodiment and some variants thereon.
Figure 6B:
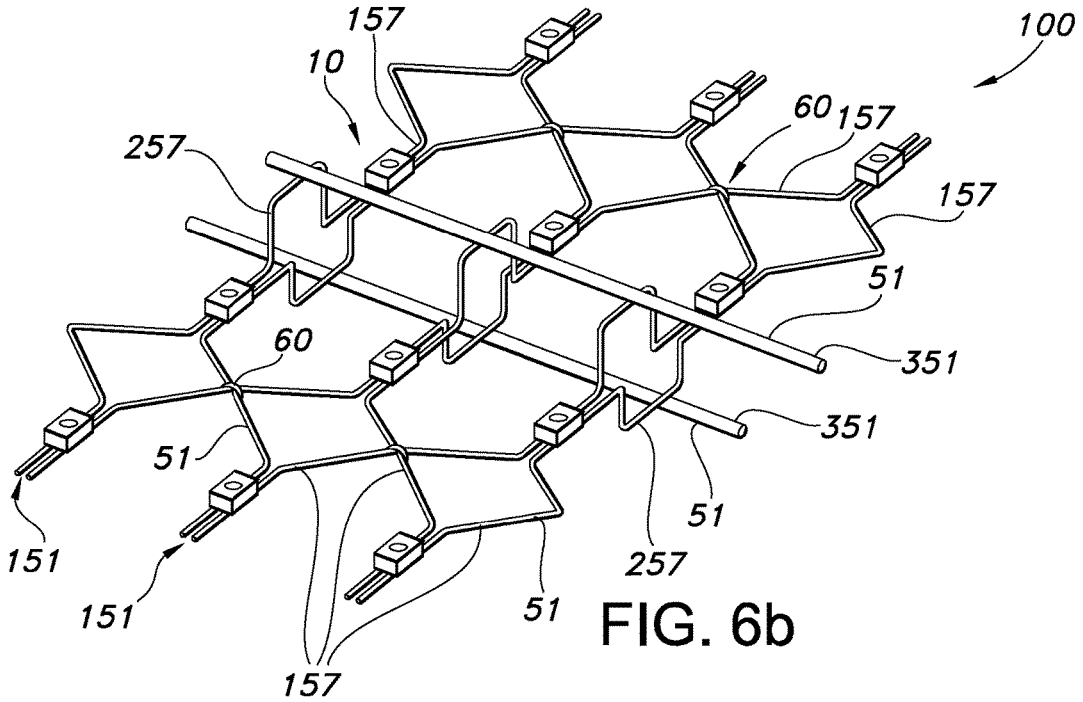

FIGS. 6*a* and 6*b* schematically depict an embodiment of the modular LED array grid 100, wherein one or more conductive wires 51 comprise first wire elements 157 which in a single plane and second wire elements 257 which protrude from said plane. In the former figures, most of the wire elements, except perhaps for the LEDs are in substantially one plane. In FIGS. 6*a*-6*b*, however, intentionally further elements are introduced, especially by additional folds, which provide second wire elements 257 which protrude from said plane. In this way, a 3D structure is provided, wherein the out of plane second wire elements 257 may for instance be used to facilitate arrangement on or between other elements, such as for instance schematically depicted in FIG. 2*a*. Especially, the out of plane second wire elements 257 may additionally or alternatively also be used for alternative power supply to the LEDs 10. Hence, in an embodiment, power wires 351 are provided, which couple to one or more second wire elements of one or more modules 50.

Figure 7A:
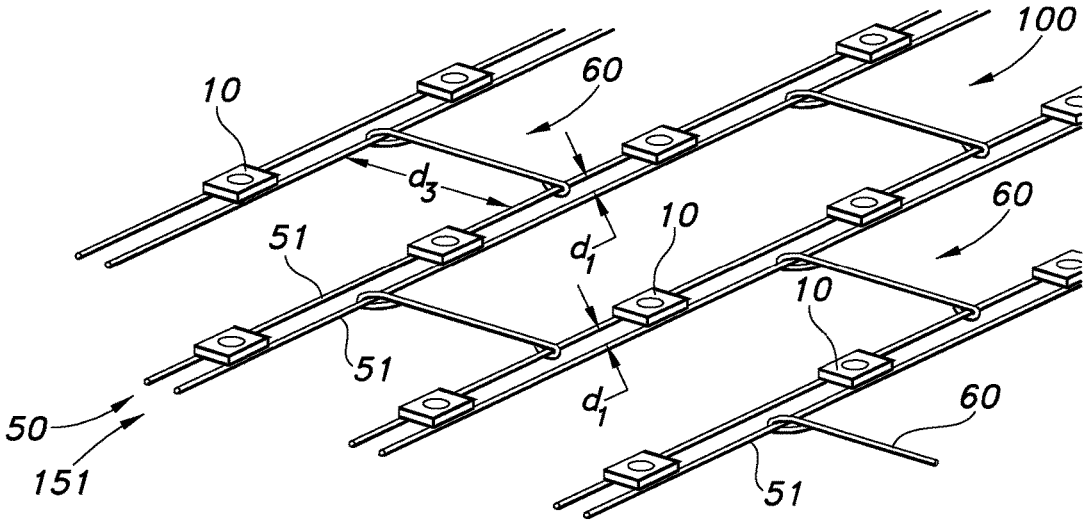
FIGS. 7*a*-7*c* schematically depicts a possible embodiment and some variants thereon.

FIG. 7*a* schematically depicts a modular LED array grid 100 comprising a plurality of LED array grid modules 50, wherein each LED array grid module 50 comprises one or more arrays 151 of adjacent electrically conductive wires 51 with one or more LEDs 10 electrically coupled to two adjacent electrically conductive wires 51 for providing electrical power to the one or more LEDs 10, wherein two adjacent electrically conductive wire 51 of at least one of the one or more arrays 151 have a first distance d1 at the one or more LEDs 10, wherein two or more of said array grid modules 50 are coupled to each other with one or more coupling parts 60 between one or more folds 52 of a first array 151(1) and the conductive wire 51 of an adjacent second array 151(2)

Figure 7B:
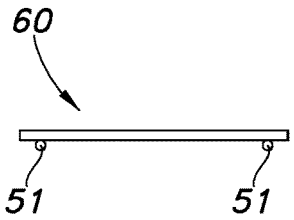
Figure 7C:
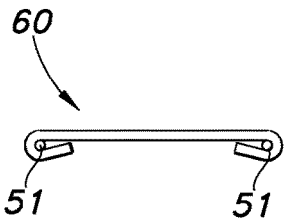

FIGS. 7*a* and 7*b* schematically depict embodiments of the connection(s) 60, which may apply to any of the embodiments described above. FIG. 7*b* schematically depicts a "simple" connection 60 which may be welded, like by resistance welding or soldering. FIG. 7*c* schematically depicts an embodiment wherein the connection can again be folded around the adjacent wires of two modules.

Hence, the connections may be additional elements, like staple connections, such as schematically depicted in FIGS. 1*d*, 3*b*, 6*a*-6*b*,7*b* and 7*c*, but the connections can also be purely based on connecting adjacent wires, such as by welding, soldering, folding, etc., such schematically depicted in FIGS. 1*c*, 3*c*, 4*a*-4*c*, and 5*a*-5*b*.

FIGS. 8*a*-8*c* and 9*a*-9*c* schematically depict some further embodiments, wherein connections 60 may comprise wire wrapping couplings, which are further also indicated with reference 160. Wire wrapping may be obtained by bringing two modules 50 next to each other, and wrapping a (conductive) wire around parts of both modules, to connect the two modules to each other. The wire wrapping may especially be applied to second wire elements 257 (on both modules). These second wire elements 257 may in an embodiment be arranged on folds of the modules 50. As indicated, a fold of a module may be connected to another module, especially to fold on such other module. Especially, folds that are configured to increase the distance between adjacent modules are desired, see also above. As can be derived from these figures, The protruding elements (here amongst others also including the elements that are wire wrapped to each other) may be attached to or be part of the conductive wires and/or to the folds, but are especially attached to or be part of to the folds.

Figure 8A:
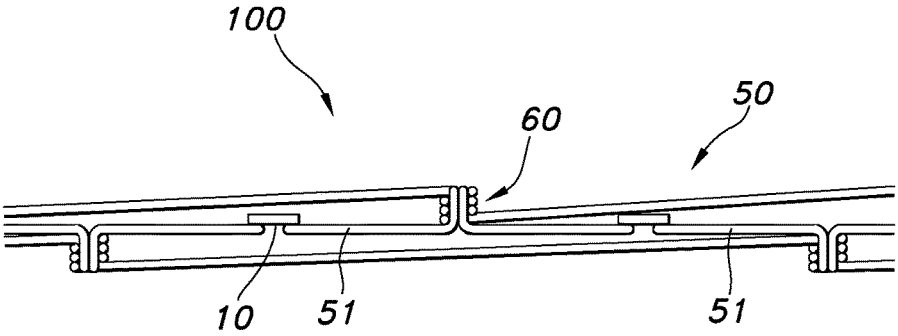
FIGS. 8*a*-8*c* schematically depicts a possible embodiment and some variants thereon.
Figure 8B:
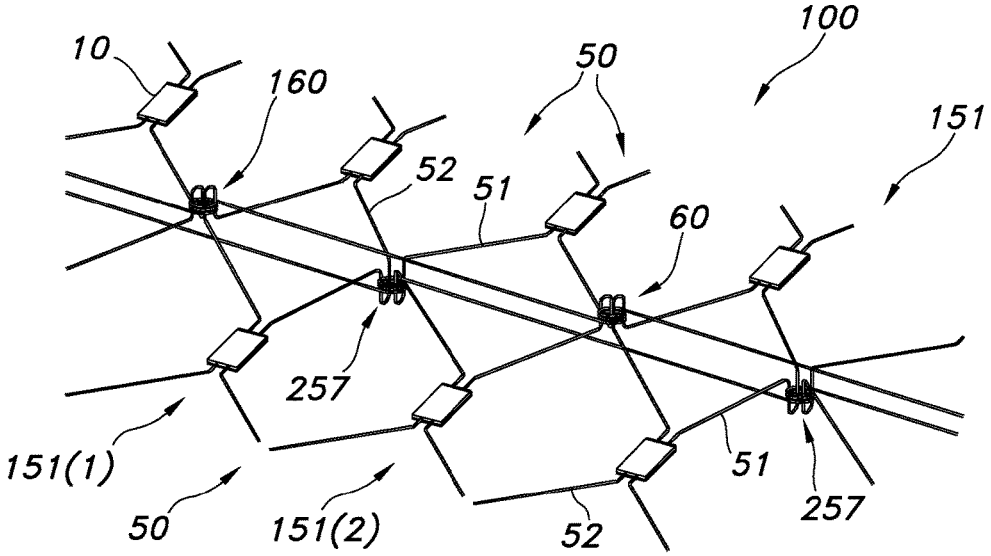
Figure 8C:
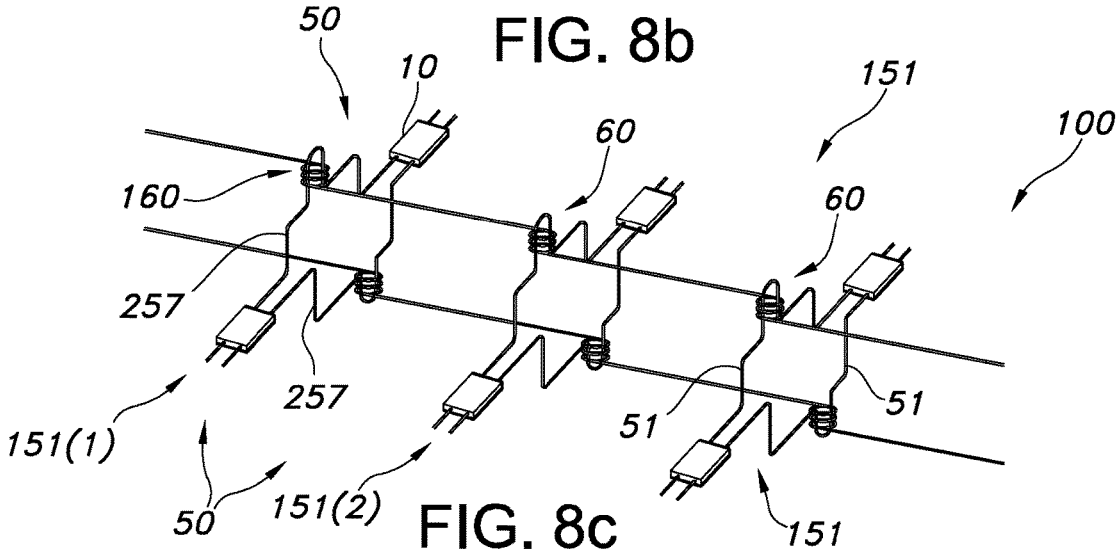
Figure 9A:
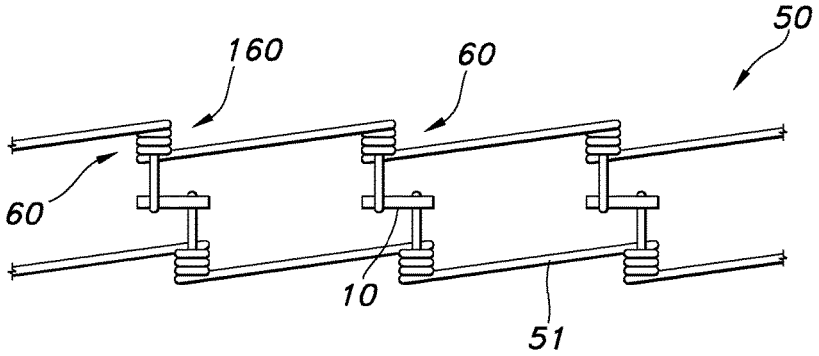
FIGS. 9*a*-9*c* schematically depicts a possible embodiment and some variants thereon The drawings are not necessarily on scale
Figure 9B:
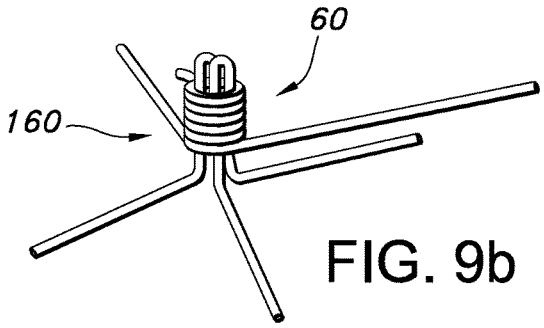
Figure 9C:
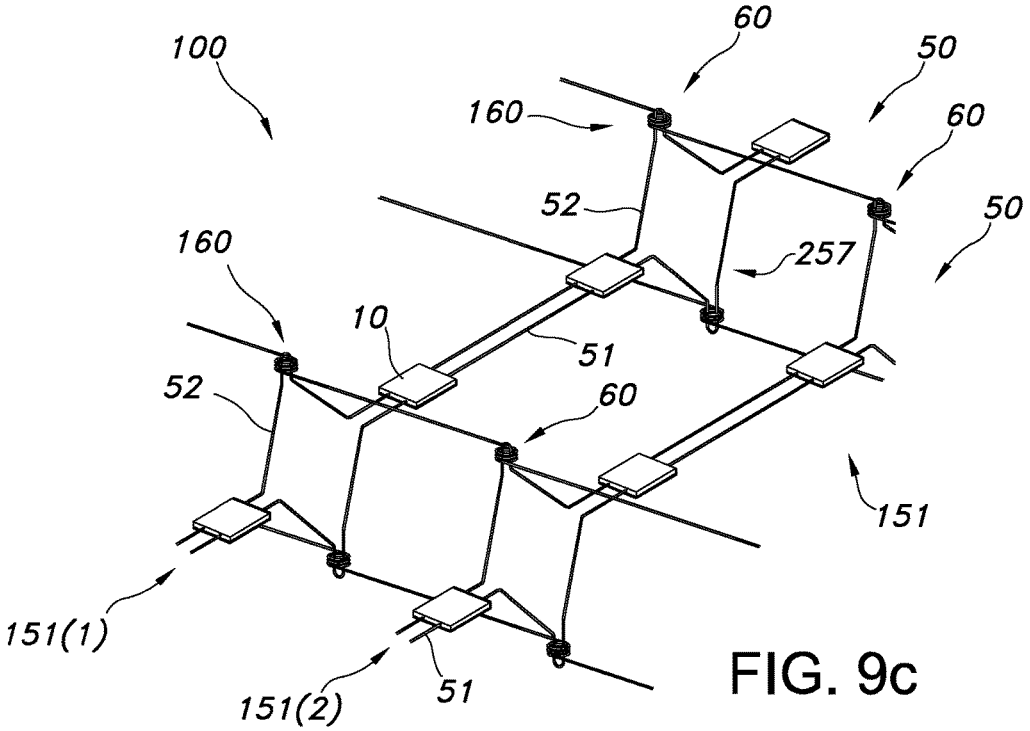

FIGS. 8*a* and 9*a* are cross-sectional view; FIGS. 8*b*, 8*c* and 9*b* are alternative embodiments. FIG. 9*a* can be a cross-section view of the embodiment schematically depicted in FIG. 8*c*. FIG. 9*b* schematically depicts in more detail an embodiment of a wire wrapping coupling.

The invention claimed is:

1. A method for providing a modular LED array grid, the method comprising:

providing a plurality of LED array grid modules, wherein each LED array grid module comprises one or more arrays of adjacent electrically conductive wires with one or more LEDs electrically coupled to two adjacent electrically conductive wires, wherein two adjacent electrically conductive wires of at least one of the one or more arrays have a first distance at the one or more LEDs, and have one or more continuous folds in said conductive wires which provide a second distance between the two adjacent electrically conductive wires which is larger than the first distance; and providing the modular LED array grid by coupling two or more array grid modules with one or more coupling parts between one or more continuous folds of a first array and the conductive wire of an adjacent second array.

2. The method according to claim 1, wherein the method comprises coupling two or more array grid modules with one or more coupling parts between one or more folds of the first array and one or more folds of the adjacent second array.

3. The method according to claim 2, wherein the adjacent electrically conductive wires and the one or more folds are configured in one plane.

4. The method according to claim 3, wherein one or more coupling parts comprise a coupling part selected from the group consisting of a staple coupling, a solder coupling, a wire wrap coupling, and a weld coupling.

5. The method according to claim 4, wherein one or more coupling parts are electrically conductive.

6. The method according to claim 5, wherein the method comprises providing two adjacent electrically conductive wires, providing one or more of the folds in one or more of the wires, and subsequently arranging one or more LEDs to the two adjacent electrically conductive wires, to provide the array.

7. The method according to claim 5, wherein the method comprises providing two adjacent electrically conductive wires, arranging one or more LEDs to the two adjacent electrically conductive wires, and subsequently providing one or more of the folds in one or more of the wires, to provide the array.

8. The method according to claim 7, comprising arranging the modular LED array grid between a support and a light transmissive cover.

9. A modular LED array grid comprising a plurality of LED array grid modules, wherein each LED array grid module comprises one or more arrays of adjacent electrically conductive wires with one or more LEDs electrically coupled to two adjacent electrically conductive wires for providing electrical power to the one or more LEDs, wherein two adjacent electrically conductive wires of at least one of the one or more arrays have a first distance at the one or more LEDs, and have one or more continuous folds in said conductive wires which provide a second distance between the two adjacent electrically conductive wires which is larger than the first distance, wherein two or more of said array grid modules are coupled to each other with one or more coupling parts between one or more continuous folds of a first array and the conductive wire of an adjacent second array.

10. The modular LED array grid according to claim 9, wherein two or more of said array grid modules are coupled to each other with one or more coupling parts between one or more folds of a first array and one or more folds of the adjacent second array.

11. The modular LED array grid according to claim 9, wherein the adjacent electrically conductive wires and the one or more folds are configured in one plane.

12. The modular LED array grid according to claim 9, wherein one or more coupling parts comprise a coupling part selected from the group consisting of a staple coupling, a solder coupling, a wire wrap coupling, and a weld coupling.

13. The modular LED array grid according to claim 9, wherein one or more coupling parts are electrically conductive.

14. The modular LED array grid according to claim 9, wherein one or more conductive wires comprise first wire elements which are configured in a single plane and second wire elements which protrude from said plane.

15. A lighting arrangement comprising a support, a transmissive cover, and the modular LED array grid according to claim 9, with the modular LED array grid configured between said support and said transmissive cover.

* * * * *